US008672435B2

(12) United States Patent
Matsuura

(10) Patent No.: US 8,672,435 B2
(45) Date of Patent: Mar. 18, 2014

(54) LIQUID EJECTING DEVICE CAPABLE OF REDUCING VOLTAGE APPLICATION PERIOD AND PREVENTING LEAKAGE OF LIQUID

(75) Inventor: Kazunari Matsuura, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 220 days.

(21) Appl. No.: 13/052,964

(22) Filed: Mar. 21, 2011

(65) Prior Publication Data

US 2011/0310147 A1 Dec. 22, 2011

(30) Foreign Application Priority Data

Jun. 21, 2010 (JP) ..... 2010-140946

(51) Int. Cl.
*B41J 29/38* (2006.01)

(52) U.S. Cl.
USPC ..... 347/10

(58) Field of Classification Search
None
See application file for complete search history.

(56) References Cited

U.S. PATENT DOCUMENTS

2007/0176978 A1* 8/2007 Sugahara ..... 347/68
2009/0244204 A1* 10/2009 Ono et al. ..... 347/68

FOREIGN PATENT DOCUMENTS

JP 2007-176097 A 7/2007
JP 2008-132657 A 6/2008
JP 2009-226676 A 10/2009

* cited by examiner

*Primary Examiner* — Stephen Meier
*Assistant Examiner* — Bradley Thies
(74) *Attorney, Agent, or Firm* — Baker Botts L.L.P.

(57) ABSTRACT

A driving-signal applying section maintains a first driving signal at a first low voltage prior to and subsequent to a first voltage application period during which voltage is applied to a first active portion based on image data for one recording medium, maintains a second driving signal at a second low voltage prior to and subsequent to a second voltage application period during which voltage is applied to a second active portion based on the image data, changes the second driving signal from the second low voltage to a second high voltage at a first time point that is a first predetermined period before a second time point that is a starting time point of the first voltage application period, and maintains the second driving signal at the second high voltage from the first time point until the second time point.

19 Claims, 10 Drawing Sheets

LIQUID EJECTING DEVICE CAPABLE OF REDUCING VOLTAGE APPLICATION PERIOD AND PREVENTING LEAKAGE OF LIQUID

CROSS REFERENCE TO RELATED APPLICATIONS

This application claims priority from Japanese Patent Application No. 2010-140946 filed Jun. 21, 2010. The entire content of the priority application is incorporated herein by reference.

TECHNICAL FIELD

The invention relates to a liquid ejecting device that ejects liquid such as ink by driving a piezoelectric-type actuator, a controller that controls driving of the piezoelectric-type actuator, and a storage medium storing a set of program instructions for controlling driving of the piezoelectric-type actuator.

BACKGROUND

In an inkjet-type printer which is an example of a liquid ejecting device, a technology is known that ink is ejected from ejection ports of a head by driving of a piezoelectric-type actuator using piezoelectric elements. The piezoelectric-type actuator is driven by application of driving signals including pulse voltages so that the volumes of pressure chambers of the head are increased or decreased and that ejection energy is applied to ink within the pressure chambers.

SUMMARY

The invention provides a liquid ejecting device including a channel member, a piezoelectric-type actuator, a driving-signal generating section, and a driving-signal applying section. The channel member is formed with a liquid channel having a plurality of ejection ports for ejecting liquid and a plurality of pressure chambers in fluid communication with respective ones of the plurality of ejection ports. The piezoelectric-type actuator includes a layered body disposed on the channel member so as to confront the plurality of pressure chambers for applying energy to liquid in the plurality of pressure chambers. The layered body includes a first piezoelectric layer and a second piezoelectric layer. The actuator includes a first active portion and a second active portion at parts of the first piezoelectric layer and the second piezoelectric layer, respectively, in confrontation with each of the plurality of pressure chambers. The first active portion and the second active portion are sandwiched between electrodes with respect to a stacking direction. The driving-signal generating section is configured to generate a driving signal for driving the actuator based on image data of an image to be recorded on a recording medium. The driving signal includes a first driving signal applied to the first active portion and a second driving signal applied to the second active portion. The driving-signal applying section is configured to apply the first driving signal and the second driving signal to the first active portion and the second active portion, respectively. The first driving signal includes one or more pulse voltage formed by a voltage change between a first low voltage and a first high voltage, the one or more pulse voltage having time width. The second driving signal includes one or more pulse voltage formed by a voltage change between a second low voltage and a second high voltage, the one or more pulse voltage having time width. The voltage change of the first driving signal from the first low voltage to the first high voltage applies a larger amount of energy to the liquid in each of the plurality of pressure chambers than the voltage change of the second driving signal from the second low voltage to the second high voltage. The driving-signal applying section is configured to maintain the first driving signal at the first low voltage prior to and subsequent to a first voltage application period during which voltage is applied to the first active portion based on the image data for one recording medium, to maintain the second driving signal at the second low voltage prior to and subsequent to a second voltage application period during which voltage is applied to the second active portion based on the image data for the one recording medium, to change the second driving signal from the second low voltage to the second high voltage at a first time point that is a first predetermined period before a second time point that is a starting time point of the first voltage application period, and to maintain the second driving signal at the second high voltage from the first time point until the second time point.

According to another aspect, the invention provides a controller for use in a liquid ejecting device including: a channel member formed with a liquid channel having a plurality of ejection ports for ejecting liquid and a plurality of pressure chambers in fluid communication with respective ones of the plurality of ejection ports; and a piezoelectric-type actuator including a layered body disposed on the channel member so as to confront the plurality of pressure chambers for applying energy to liquid in the plurality of pressure chambers, the layered body including a first piezoelectric layer and a second piezoelectric layer, the actuator including a first active portion and a second active portion at parts of the first piezoelectric layer and the second piezoelectric layer, respectively, in confrontation with each of the plurality of pressure chambers, the first active portion and the second active portion being sandwiched between electrodes with respect to a stacking direction. The controller includes a driving-signal generating section and a driving-signal applying section. The driving-signal generating section is configured to generate a driving signal for driving the actuator based on image data of an image to be recorded on a recording medium. The driving signal includes a first driving signal applied to the first active portion and a second driving signal applied to the second active portion. The driving-signal applying section is configured to apply the first driving signal and the second driving signal to the first active portion and the second active portion, respectively. The first driving signal includes one or more pulse voltage formed by a voltage change between a first low voltage and a first high voltage, the one or more pulse voltage having time width. The second driving signal includes one or more pulse voltage formed by a voltage change between a second low voltage and a second high voltage, the one or more pulse voltage having time width. The voltage change of the first driving signal from the first low voltage to the first high voltage applies a larger amount of energy to the liquid in each of the plurality of pressure chambers than the voltage change of the second driving signal from the second low voltage to the second high voltage. The driving-signal applying section is configured to maintain the first driving signal at the first low voltage prior to and subsequent to a first voltage application period during which voltage is applied to the first active portion based on the image data for one recording medium, to maintain the second driving signal at the second low voltage prior to and subsequent to a second voltage application period during which voltage is applied to the second active portion based on the image data for the one recording medium, to change the second driving signal from the second low voltage to the second high voltage at a first time point that is a first predetermined period before a second time point that is a starting time point of the first voltage application period, and to maintain the second driving signal at the second high voltage from the first time point until the second time point.

According to still another aspect, the invention provides a storage medium storing a set of program instructions executable on a liquid ejecting device including: a channel member formed with a liquid channel having a plurality of ejection ports for ejecting liquid and a plurality of pressure chambers in fluid communication with respective ones of the plurality of ejection ports; and a piezoelectric-type actuator including a layered body disposed on the channel member so as to confront the plurality of pressure chambers for applying energy to liquid in the plurality of pressure chambers, the layered body including a first piezoelectric layer and a second piezoelectric layer, the actuator including a first active portion and a second active portion at parts of the first piezoelectric layer and the second piezoelectric layer, respectively, in confrontation with each of the plurality of pressure chambers, the first active portion and the second active portion being sandwiched between electrodes with respect to a stacking direction. The set of program instructions includes: generating a driving signal for driving the actuator based on image data of an image to be recorded on a recording medium, the driving signal including a first driving signal applied to the first active portion and a second driving signal applied to the second active portion; and applying the first driving signal and the second driving signal to the first active portion and the second active portion, respectively. The first driving signal includes one or more pulse voltage formed by a voltage change between a first low voltage and a first high voltage, the one or more pulse voltage having time width. The second driving signal includes one or more pulse voltage formed by a voltage change between a second low voltage and a second high voltage, the one or more pulse voltage having time width. The voltage change of the first driving signal from the first low voltage to the first high voltage applies a larger amount of energy to the liquid in each of the plurality of pressure chambers than the voltage change of the second driving signal from the second low voltage to the second high voltage. The instructions for applying the first driving signal and the second driving signal include maintaining the first driving signal at the first low voltage prior to and subsequent to a first voltage application period during which voltage is applied to the first active portion based on the image data for one recording medium, maintaining the second driving signal at the second low voltage prior to and subsequent to a second voltage application period during which voltage is applied to the second active portion based on the image data for the one recording medium, changing the second driving signal from the second low voltage to the second high voltage at a first time point that is a first predetermined period before a second time point that is a starting time point of the first voltage application period, and maintaining the second driving signal at the second high voltage from the first time point until the second time point.

BRIEF DESCRIPTION OF THE DRAWINGS

Embodiments in accordance with the invention will be described in detail with reference to the following figures wherein:

FIGS. 9A and 9B are graphs specifically showing voltage changes of each of the surface electrode and the internal electrode during the recording period, wherein FIG. 9A shows voltage changes of the surface electrode and FIG. 9B shows voltage changes of the internal electrode.

DETAILED DESCRIPTION

Figure 1:
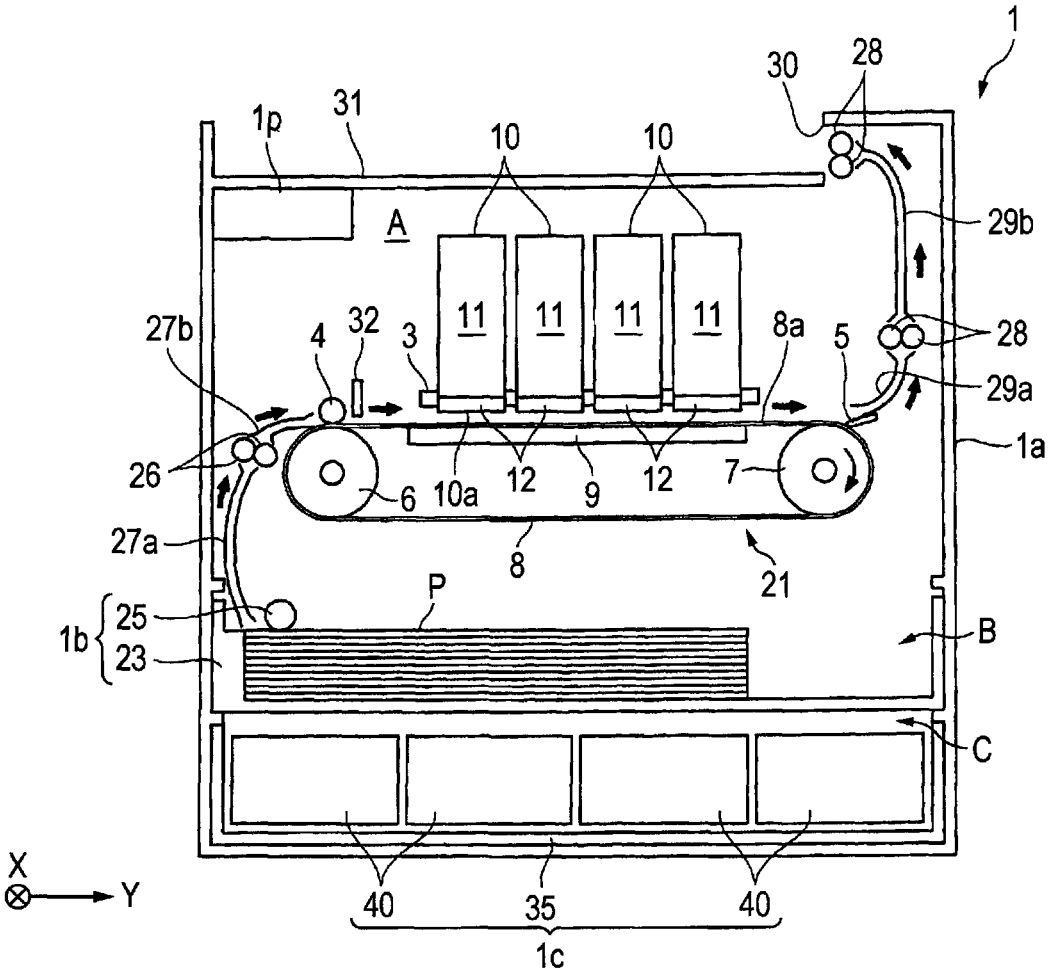
FIG. 1 is a schematic side view showing the internal structure of an inkjet-type printer embodying a liquid ejecting device according to an embodiment of the invention.

A liquid ejecting device according to some aspects of the invention will be described while referring to the accompanying drawings. In the following description, the expressions "upper" and "lower" are used to define the various parts when the liquid ejecting device is disposed in an orientation in which it is intended to be used.

First, the overall configuration of an inkjet-type printer 1 embodying the liquid ejecting device according to an embodiment will be described while referring to FIG. 1.

The printer 1 has a casing 1*a* having a rectangular parallelepiped shape. A paper discharging section 31 is provided on a top plate of the casing 1*a*. The internal space of the casing 1*a* is divided into spaces A, B, and C in this order from the top. The spaces A and B are spaces in which a paper conveying path leading to the paper discharging section 31 is formed. In the space A, conveyance of paper P and image formation onto paper P are performed. In the space B, operations for feeding paper are performed. In the space C, an ink cartridge 40 as an ink supply source is accommodated.

Four inkjet heads 10, a conveying unit 21 that conveys paper P, a guide unit (described later) that guides paper P, and the like are arranged in the space A. A controller 1*p* is disposed at the top part of the space A. The controller 1*p* controls operations of each section of the printer 1 including these mechanisms and manages the overall operations of the printer 1.

The controller 1*p* controls preparatory operations for image formation, operations for supplying, conveying, and discharging paper P, an ink ejecting operation in synchronous with conveyance of paper P, operations for recovering and maintaining ejection performance (maintenance operation), and the like, so that an image can be recorded on paper P based on image data supplied from outside.

The controller 1*p* includes a CPU (Central Processing Unit), a ROM (Read Only Memory), a RAM (Random Access Memory: including non-volatile RAM), ASIC (Application Specific Integrated Circuit), I/F (Interface), I/O (Input/Output Port), and the like. The ROM stores programs executed by the CPU, various constant data, and the like. The RAM temporarily stores data (image data, for example) that are required when the programs are executed. The ASIC performs rewriting, rearrangement, etc. of image data (signal processing and image processing). The I/F transmits data to and receives data from a higher-level device. The I/O performs input/output of detection signals of various signals. Each functioning section of the controller 1*p* is configured by cooperation between these hardware configurations and the programs in the ROM.

Each head 10 is a line head having substantially a rectangular parallelepiped shape elongated in a main scanning direction X. The four heads 10 are arranged in a sub-scanning direction Y with a predetermined pitch, and are supported by the casing 1*a* via a head frame 3. Each head 10 includes a channel unit 12, eight actuator units 17 (see FIG. 2), and a reservoir unit 11. During image formation, ink of magenta, cyan, yellow, and black colors are ejected from the lower surface (ejection surface 10*a*) of a corresponding one of the four heads 10, respectively. More specific configurations of the heads 10 will be described later in greater detail.

As shown in FIG. 1, the conveying unit 21 includes belt rollers 6 and 7, an endless-type conveying belt 8 looped around the both rollers 6 and 7, a nip roller 4 and a separation plate 5 arranged outside the conveying belt 8, a platen 9 disposed inside the conveying belt 8, and the like.

The belt roller 7 is a drive roller, and rotates by driving of a conveying motor (not shown) in the clockwise direction in FIG. 1. Rotation of the belt roller 7 causes the conveying belt 8 to move in directions shown by the thick arrows in FIG. 1. The belt roller 6 is a follow roller, and rotates in the clockwise direction in FIG. 1 by following the movement of the conveying belt 8. The nip roller 4 is disposed to confront the belt roller 6, and presses paper P supplied from an upstream-side guide section (described later) against an outer peripheral surface 8*a* of the conveying belt 8. The separation plate 5 is disposed to confront the belt roller 7, and separates paper P from the outer peripheral surface 8*a* and guides the same to a downstream-side guide section (described later). The platen 9 is disposed to confront the four heads 10, and supports an upper loop of the conveying belt 8 from the inside. With this arrangement, a predetermined gap suitable for image formation is formed between the outer peripheral surface 8*a* and the ejection surfaces 10*a* of the heads 10.

The guide unit includes the upstream-side guide section and the downstream-side guide section which are arranged with the conveying unit 21 interposed therebetween. The upstream-side guide section includes two guides 27*a* and 27*b* and a pair of feed rollers 26. The upstream-side guide section connects a paper supplying unit 1*b* (described later) and the conveying unit 21. The downstream-side guide section includes two guides 29*a* and 29*b* and two pairs of feed rollers 28. The downstream-side guide section connects the conveying unit 21 and the paper discharging section 31.

In the space B, the paper supplying unit 1*b* is disposed. The paper supplying unit lb includes a paper supplying tray 23 and a paper supplying roller 25. The paper supplying tray 23 is detachable from the casing 1*a*. The paper supplying tray 23 is a box which is opened upward, and can accommodate paper P in a plurality of sizes. The paper supplying roller 25 picks up paper P at the topmost position in the paper supplying tray 23 and supplies the same to the upstream-side guide section.

As described above, in the spaces A and B, a paper conveying path is formed from the paper supplying unit 1*b* via the conveying unit 21 to the paper discharging section 31. Based on a print command, the controller 1*p* drives a paper supplying motor (not shown) for the paper supplying roller 25, a feed motor (not shown) for feed rollers of each guide section, the conveying motor, and the like. Paper P sent out of the paper supplying tray 23 is supplied to the conveying unit 21 by the pair of feed rollers 26. When the paper P passes positions directly below each head 10 in the sub-scanning direction Y, ink droplets are ejected from the ejection surfaces 10*a* sequentially so that a color image is formed on the paper P. Ejecting operations of ink droplets are performed based on detection signals from a paper sensor 32. The paper P is then separated by the separation plate 5 and is conveyed upward by the two pairs of feed rollers 28. Further, the paper P is discharged onto the paper discharging section 31 through an opening 30 at the top of the apparatus.

Here, the sub-scanning direction Y is a direction parallel to the conveying direction of paper P by the conveying unit 21. The main scanning direction X is a direction parallel to a horizontal surface and perpendicular to the sub-scanning direction Y.

In the space C, an ink unit 1*c* is disposed so as to be detachable from the casing 1*a*. The ink unit 1*c* includes a cartridge tray 35 and four cartridges 40 arranged side by side within the cartridge tray 35. Each cartridge 40 supplies ink to a corresponding one of the heads 10 via an ink tube (not shown).

The configuration of the heads 10 will be described in greater detail with reference to FIGS. 2 through 5. Note that, in FIG. 3, pressure chambers 16 and apertures 15 are located below the actuator units 17 and should be strictly shown in dotted lines, but these are shown in the solid lines for simplicity in FIG. 3.

Figure 5:
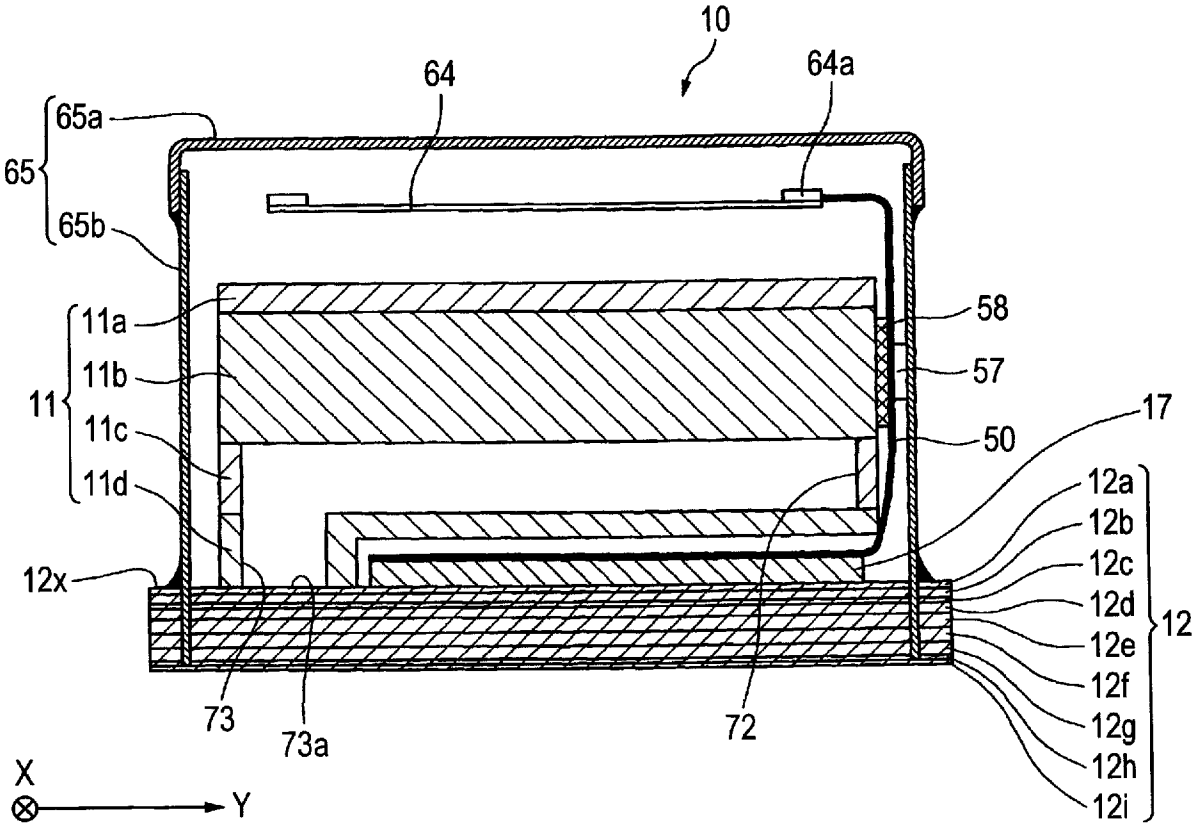
FIG. 5 is a vertical cross-sectional view of the inkjet head.

As shown in FIG. 5, the head 10 is a layered body in which the channel unit 12, the actuator unit 17, the reservoir unit 11, and a board 64 are stacked. Among these, the actuator unit 17, the reservoir unit 11, and the board 64 are accommodated in a space defined by an upper surface 12*x* of the channel unit 12 and a cover 65. In this space, a FPC (flat flexible print circuit board) 50 electrically connects the actuator unit 17 and the board 64. A driver IC 57 is mounted on the FPC 50.

As shown in FIG. 5, the cover 65 includes a top cover 65*a* and a side cover 65*b*. The cover 65 is a box which is opened downward, and is fixed to the upper surface 12*x* of the channel unit 12. The driver IC 57 abuts on the inner surface of the side cover 65*b* and is thermally coupled to the side cover 65*b*. Note that, in order to ensure the thermal coupling, the driver IC 57 is urged by an elastic member 58 (for example, a sponge) fixed to the side surface of the reservoir unit 11 toward the side cover 65*b* side.

The reservoir unit 11 is a layered body in which four metal plates 11*a*-11*d* are bonded with one another. An ink channel including a reservoir 72 for ink is formed inside the reservoir unit 11. One end of the ink channel is connected to the cartridge 40 via a tube or the like, whereas the other end is connected to the channel unit 12. As shown in FIG. 5, the lower surface of the plate 11*d* is formed with concavities and convexities. The concavities provide spaces between the plate 11*d* and the upper surface 12*x*. The actuator unit 17 is fixed to the upper surface 12*x* in this space, so that a certain gap is formed above the FPC 50. The plate 11*d* is formed with an ink outflow channel 73. The ink outflow channel 73 opens in an end surface of the convex portion of the lower surface of the plate lid (that is, the surface bonded with the upper surface 12*x*).

Figure 2:
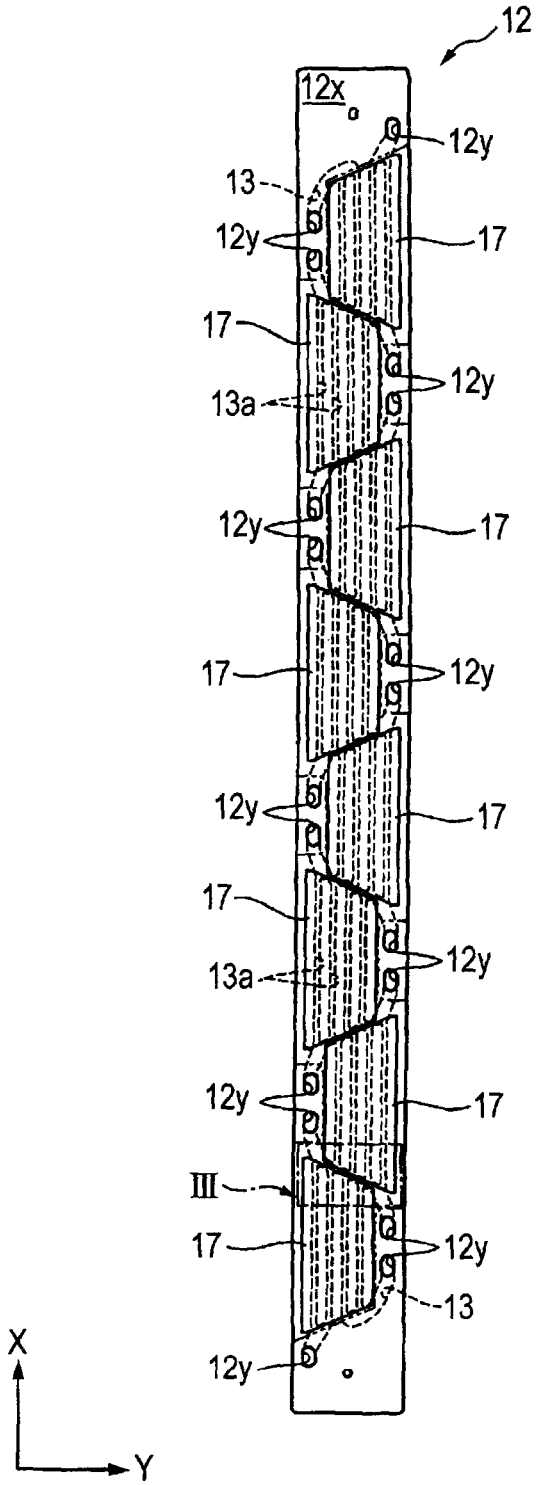
FIG. 2 is a plan view showing a channel unit and actuator units of an inkjet head included in the printer of FIG. 1.
Figure 3:
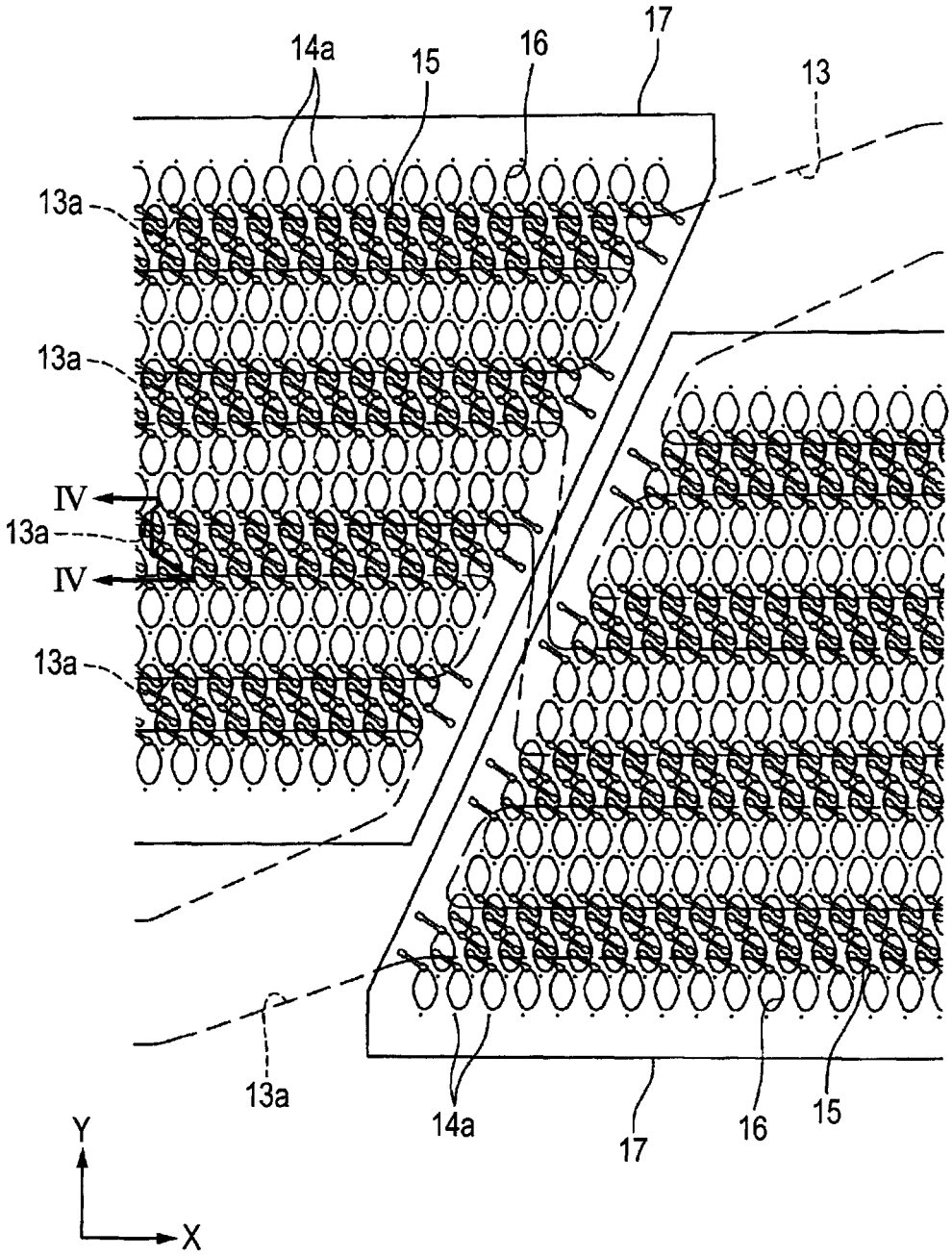
FIG. 3 is an enlarged view showing a region III surrounded by the single-dot chain line in FIG. 2.
Figure 4:
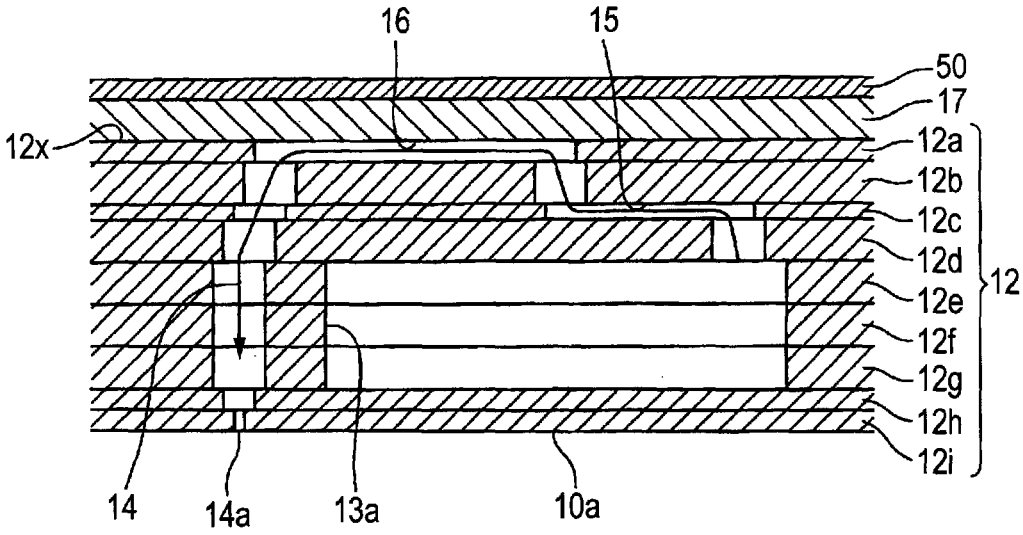
FIG. 4 is a partial cross-sectional view along a line IV-IV in FIG. 3.

The channel unit 12 is a layered body in which nine rectangular-shaped metal plates 12*a*, 12*b*, 12*c*, 12*d*, 12*e*, 12*f*, 12*g*, 12*h*, and 12*i* having substantially the same size (see FIG. 4) are bonded with one another. As shown in FIG. 2, the upper surface 12*x* of the channel unit 12 is formed with openings 12*y* in confrontation with a corresponding one of openings 73*a* of the ink outflow channel 73. Within the channel unit 12, ink channels are formed to connect from the openings 12*y* to ejection ports 14*a*. As shown in FIGS. 2, 3, and 4, the ink channel includes a manifold channel 13 having the opening 12*y* at one end thereof, subsidiary manifold channels 13*a* branching off from the manifold channel 13, and individual ink channels 14 running from outlets of the subsidiary manifold channels 13*a* via the pressure chambers 16 to the ejection ports 14*a*.

As shown in FIG. 3, each pressure chamber 16 has substantially a diamond shape. The pressure chambers 16 are arranged in a matrix configuration so as to form a total of eight pressure-chamber groups each occupying substantially a trapezoidal region in a plan view. Like the pressure chambers 16, the ejection ports 14*a* are arranged in a matrix configuration so as to form a total of eight ejection-port groups each occupying substantially a trapezoidal region in a plan view.

As shown in FIG. 2, each actuator unit 17 has a trapezoidal shape in plan view. The actuator units 17 are arranged in a staggered configuration (in two rows) on the upper surface 12*x* of the channel unit 12. Further, as shown in FIG. 3, each actuator unit 17 is arranged on a trapezoidal region occupied by a pressure-chamber group (ejection-port group).

The FPC 50 is provided for each actuator unit 17. Wiring corresponding to each electrode of the actuator unit 17 is connected to a corresponding one of the output terminals of the driver IC 57. Under controls by the controller 1*p* (see FIG. 1), the FPC 50 transmits data adjusted in the board 64 to the driver IC 57, and transmits each driving voltage generated by the driver IC 57 (described later in greater detail) to each electrode of the actuator unit 17. The driving voltage is selectively applied to each electrode of the actuator unit 17.

Next, the configuration of the actuator unit 17 will be described with reference to FIGS. 6A through 6C.

Figure 6A:
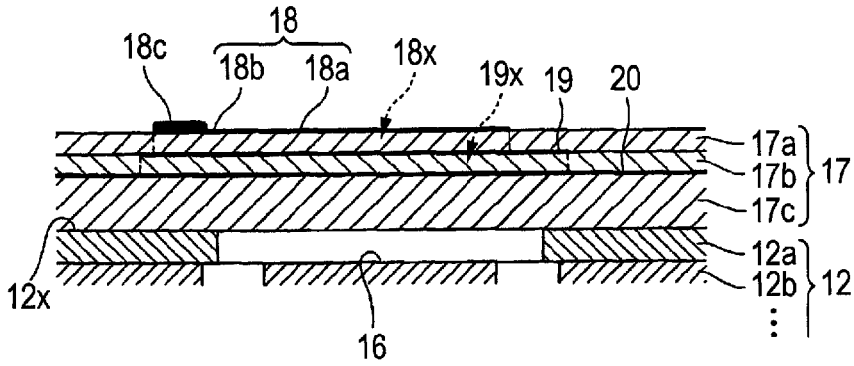
FIG. 6A is a partial cross-sectional view showing one of the actuator units in FIG. 2.
Figure 6B:
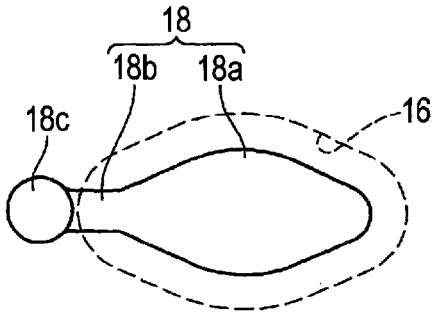
FIG. 6B is a plan view showing a surface electrode included in the actuator unit.

As shown in FIG. 6A, the actuator unit 17 includes a layered body of two piezoelectric layers 17*a* and 17*b*, and a vibration plate 17*c* arranged between the layered body and the channel unit 12. The piezoelectric layers 17*a* and 17*b* and the vibration plate 17*c* are all sheet-like members made of ceramic materials of lead zirconate titanate (PZT) series having ferroelectricity. The piezoelectric layers 17*a* and 17*b* are polarized in the same direction along the stacking direction thereof.

The piezoelectric layers 17*a* and 17*b* and the vibration plate 17*c* have the same size and shape (a trapezoidal shape defining one actuator unit 17) as viewed in the thickness direction of the piezoelectric layers 17*a* and 17*b*. That is, the piezoelectric layers 17*a* and 17*b* and the vibration plate 17*c* are arranged to straddle a large number of the pressure chambers 16 included in one pressure-chamber group so as to confront these pressure chambers 16. Here, the vibration plate 17*c* seals all of the pressure chambers 16 included in one pressure-chamber group. The thickness of the vibration plate 17*c* is greater than or equal to a sum of the thickness of the piezoelectric layer 17*a* and the thickness of the piezoelectric layer 17*b*.

The upper surface of the piezoelectric layer 17*a* is formed with a large number of surface electrodes 18 corresponding to the respective ones of the pressure chambers 16. An internal electrode 19 is formed between the piezoelectric layer 17*a* and the piezoelectric layer 17*b* under the piezoelectric layer 17*a*. A common electrode 20 is formed between the piezoelectric layer 17*b* and the vibration plate 17*c* under the piezoelectric layer 17*b*. No electrode is formed on the lower surface of the vibration plate 17*c*.

The surface electrodes 18 are provided for respective ones of the pressure chambers 16. Like the pressure chambers 16, the surface electrodes 18 are arranged in a matrix configuration so as to form a plurality of rows and a plurality of columns. As shown in FIG. 6B, each surface electrode 18 includes a main electrode region 18*a* having substantially a diamond shape, an extension portion 18*b* extending from one of the acute angle portions of the main electrode region 18*a*, and a land 18*c* formed on the extension portion 18*b*. The shape of the main electrode region 18*a* is a similarity shape to that of the pressure chamber 16, while the size of the main electrode region 18*a* is smaller than that of the pressure chamber 16. In a plan view, the main electrode region 18*a* is arranged within the pressure chamber 16. The extension portion 18*b* extends to a region outside of the pressure chamber 16, and the land 18*c* is arranged at a distal end of the extension portion 18*b*. The land 18*c* has a circular shape in a plan view, and does not confront the pressure chamber 16. The land 18*c* has a height of approximately 50 μm (micrometers) from the upper surface of the piezoelectric layer 17*a*. The land 18*c* is electrically connected to an electrode of wiring of the FPC 50. The piezoelectric layer 17*a* and the FPC 50 confront each other with a gap of approximately 50 μm (micrometers), at regions except the electrical connection point. With this configuration, free deformation of the actuator units 17 can be ensured.

Figure 6C:
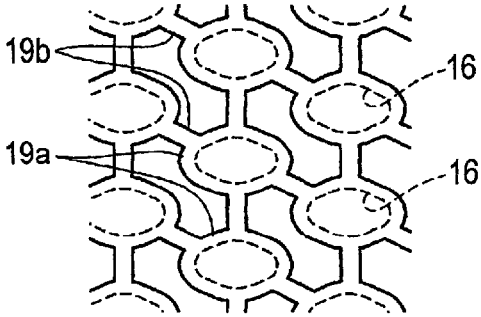
FIG. 6C is a plan view showing an internal electrode included in the actuator unit.

As shown in FIG. 6C, the internal electrode 19 includes a large number of individual electrodes 19*a* that confronts the respective ones of the pressure chambers 16, and a large number of connection electrodes 19*b* that connects the individual electrodes 19*a* with one another. The shape of each individual electrode 19*a* is a similarity shape to that of the pressure chamber 16 as viewed in the stacking direction of the piezoelectric layers 17*a* and 17*b*. The size of the individual electrode 19*a* is larger than that of the pressure chamber 16. In a plan view, the individual electrode 19*a* includes the pressure chamber 16 therein. All of the individual electrodes 19*a* of the internal electrode 19 formed on one actuator unit 17 are connected with one another by the connection electrodes 19*b*, and thus are kept at the same electric potential.

The common electrode 20 is an electrode shared by all the pressure chambers 16 corresponding to one actuator unit 17. The common electrode 20 is formed on the entire surface of the vibration plate 17*c*.

The upper surface of the piezoelectric layer 17*a* is formed with a land for the internal electrode (not shown) and a land for the common electrode (not shown), in addition to the land 18*c* for the surface electrode. The land for the internal electrode is electrically connected to the internal electrode 19 via a through hole of the piezoelectric layer 17*a*. The land for the common electrode is electrically connected to the common electrode 20 via a through hole penetrating the piezoelectric layers 17*a* and 17*b*. On the upper surface of the piezoelectric layer 17*a*, the land for the internal electrode is arranged at substantially the center of each side of a trapezoidal shape, and the land for the common electrode is arranged near each corner of the trapezoidal shape. Each land is connected with terminals of the FPC 50. Among these, the land for the common electrode is connected with a wiring connected to ground, and the land for the internal electrode is connected with a wiring extending from the output terminal of the driver IC 57.

The piezoelectric layer 17*a* includes a first active portion 18*x* at a part interposed between the electrodes 18 and 19. The piezoelectric layer 17*b* includes a second active portion 19*x* at a part interposed between the electrodes 19 and 20. Each active portion 18*x*, 19*x* is displaced in at least one vibration mode selected from among $d_{31}$, $d_{33}$, and $d_{15}$ ($d_{31}$ in the present embodiment). A portion of the vibration plate 17*c* corresponding the active portion 18*x*, 19*x* with respect to the thickness direction is a non-active portion which is not interposed between electrodes. That is, the actuator unit 17 includes, for each pressure chamber 16, a unimorph-type piezoelectric-type actuator in which the first active portion 18*x*, the second active portion 19*x*, and one non-active portion are stacked.

Each piezoelectric-type actuator can be deformed independently. The actuator unit 17 applies energy to ink within the pressure chamber 16 by deformation of the piezoelectric-type actuator.

If an electric field is applied only to the first active portion 18*x* in the same direction as the polarizing direction, for example, then the first active portion 18*x* contracts in the surface direction by the piezoelectric lateral effect, but each of the second active portion 19*x* and the non-active portion does not deform by itself. At this time, because difference in deformation occurs between the both (between the first active portion 18*x*, and the second active portion 19*x* and the non-active portion), a part of the actuator 17 confronting the pressure chamber 16 (piezoelectric-type actuator) as a whole deforms to be convex toward the pressure chamber 16, and ejection energy is applied to ink within the pressure chamber 16.

Figure 7:
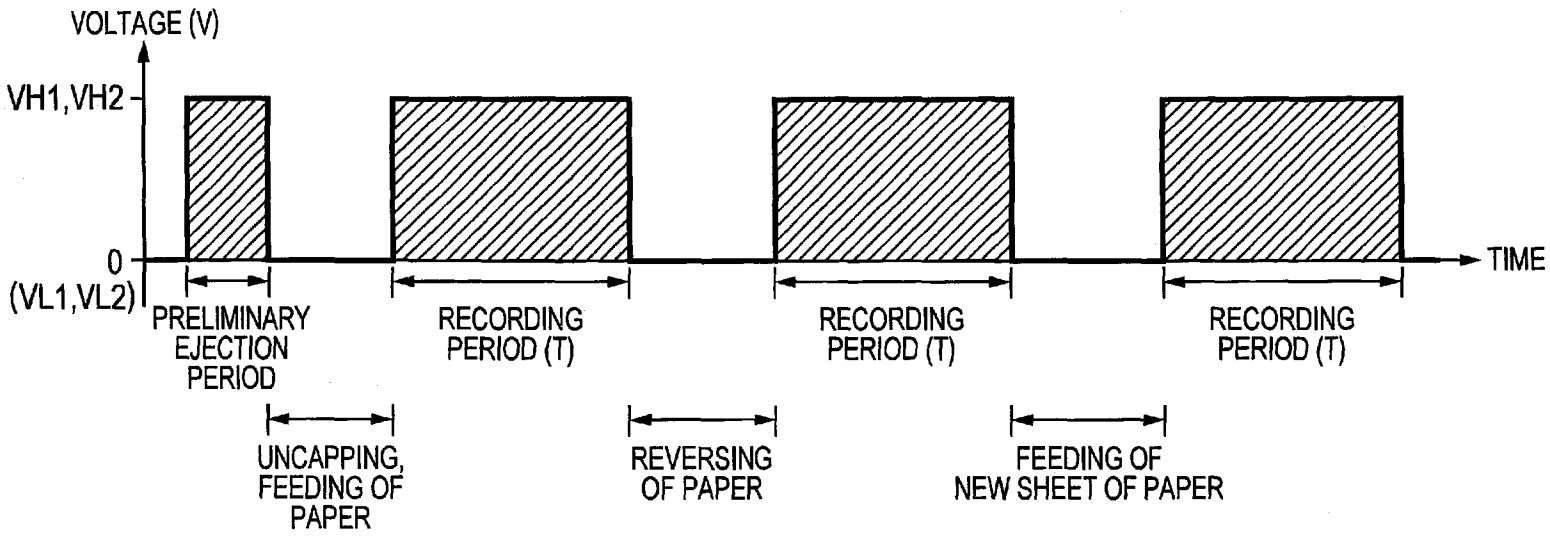
FIG. 7 is a graph schematically showing voltage changes of the surface electrode and the internal electrode based on a print command.

Next, descriptions will be provided for changes of voltages applied to the first active portion 18*x* and the second active portion 19*x* based on a print command while referring to FIG. 7.

Figure 8:
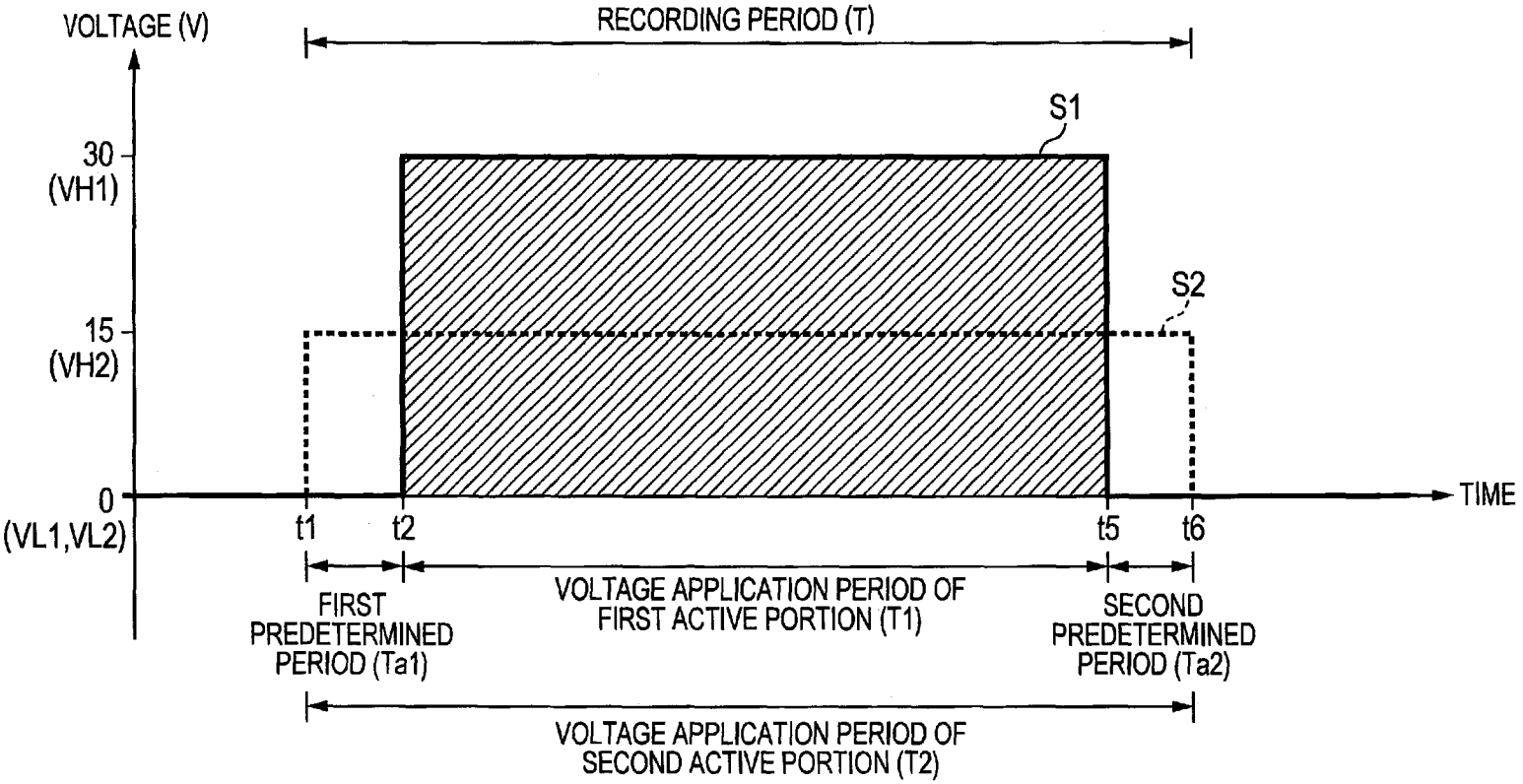
FIG. 8 is a graph schematically showing voltage changes of the surface electrode and the internal electrode during a recording period.
Figure 9A:
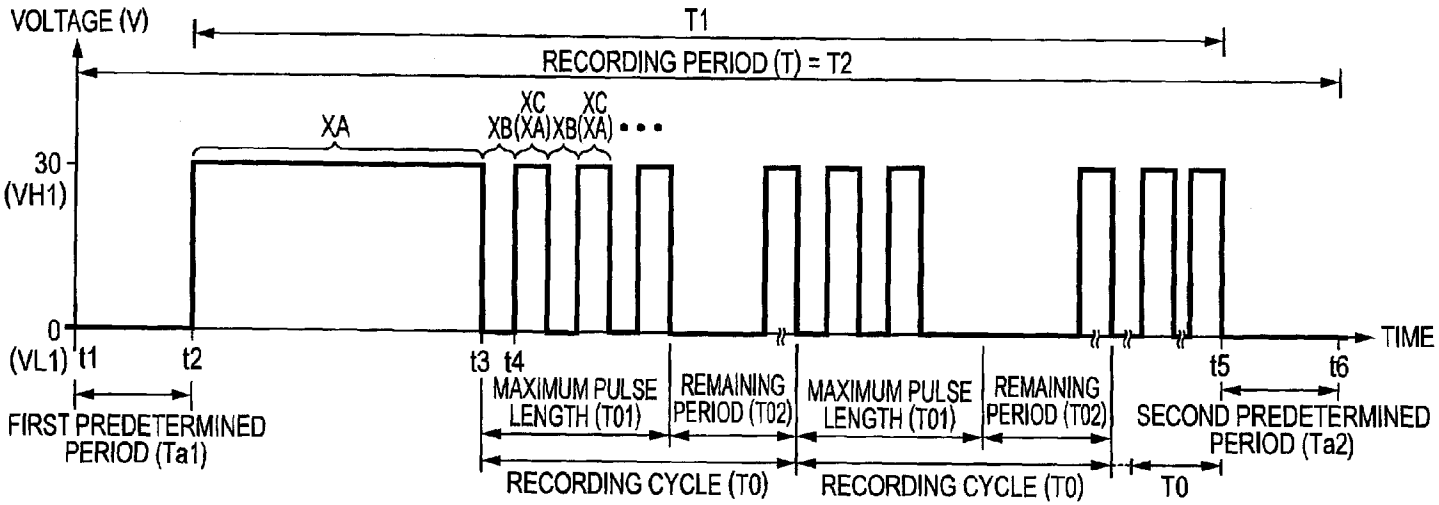
Figure 9B:
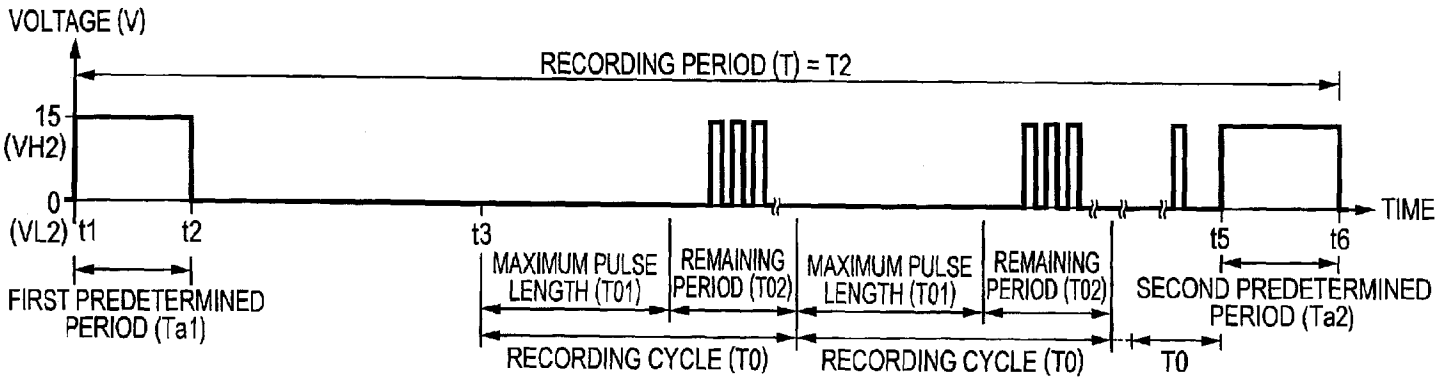

The electric potential of the common electrode 20 is always kept at ground potential (0V). The electric potential of the surface electrode 18 changes so that either a first low voltage VL1 (0V, for example) or a first high voltage VH1 (30V, for example) is applied to the first active portion 18*x*. The electric potential of the internal electrode 19 changes so that either a second low voltage VL2 (0V, for example) or a second high voltage VH2 (15V(=VH1*½), for example) is applied to the second active portion 19*x*. In FIG. 7, the first high voltage VH1 and the second high voltage VH2 are shown as voltages of the same value, although the voltages VH1 and VH2 are actually different. Further, although a voltage applied to each of the active portions 18*x* and 19*x* changes in pulse shapes during periods shown by the hatched lines in FIG. 7 (recording period T and a preliminary ejection period), the changes of the voltage are not shown in FIG. 7. The changes in the voltage of each active portion 18*x*, 19*x* during the recording period T are shown in FIGS. 8, 9A and 9B.

As shown in FIG. 7, voltages applied to the first active portion 18*x* and the second active portion 19*x* are kept at the first low voltage VL1 and the second low voltage VL2, respectively, during periods except the recording periods T (voltage application periods based on image data for one sheet of paper P) and the preliminary ejection period (a period for recovery and maintenance operations of ink ejection performance of the ejection ports 14*a*), that is, a capping period prior to a preliminary ejection period, a period in which uncapping and feeding of paper P are performed, a period for reversing paper, a period for feeding a new sheet of paper P, and the like.

After receipt of a print command, first, preliminary ejection is performed. The preliminary ejection is an operation for recovering and maintaining ink ejection performance, and is performed, for example, when the power of the printer 1 is turned on, and immediately before a recording operation (an operation of ejecting ink from the ejection ports 14*a* based on image data) by the head 10 is restarted after the recording operation has not been performed for a predetermined period or longer. During the preliminary ejection, ink is ejected from the ejection ports 14*a* by driving of the actuator unit 17. By performing preliminary ejection, ink with increased viscosity within the ejection ports 14*a* can be discharged, and menisci formed in the ejection ports 14*a* can be regenerated. During the preliminary ejection, the ejection surface 10*a* is covered by a cap (not shown), so that ink is discharged into the cap.

After the preliminary ejection is performed, the cap is moved to a standby position at which the cap does not confront the ejection surface 10*a* (uncapping), the ejection surface 10*a* is wiped by a wiper, and feeding of paper P is performed. Then, application of voltage is started based on image data for the paper P, in accordance with timing at which a recording region of the paper P confronts the ejection surface 10*a* (changes in voltage of each of the active portions 18*x* and 19*x* during the recording period T will be described later in greater detail with reference to FIGS. 8, 9A, and 9B). In the case of two-sided recording, after the recording period T for the top side of paper P ends, the paper P is reversed so that an image is recorded on the bottom side of the paper P. Further, in the case of continuous recording on two or more sheets of paper P, after the recording period T for one sheet of paper P ends, feeding of a new sheet of paper P is performed so that an image is recorded on the new sheet of paper P.

Next, descriptions will be provided for changes in voltages applied to the active portions 18*x* and 19*x* during the recording period T and periods prior to and subsequent to the recording period T, while referring to FIGS. 8, 9A, and 9B. In FIG. 8, voltage changes of the first active portion 18*x* are indicated by solid lines S1, and voltage changes of the second active portion 19*x* are indicated by dotted lines S2. Further, voltage changes of each active portion 18*x*, 19*x* in a part indicated by the hatched lines are omitted in FIG. 8. These voltage changes are shown specifically in FIGS. 9A and 9B.

The recording period T is a series of voltage application periods that are necessary for image formation on one sheet of paper P, and is divided into three parts of a preceding part (Ta1), a middle part (T1), and a following part (Ta2). The preceding part (Ta1) is a period in which the actuators changes from a paused state to a standby state in which the actuators can be driven based on image data. The middle part (or first voltage application period) (T1) is a period in which the actuators are in a state of being driven based on image data (a print state). Ink is ejected onto paper P at each recording cycle T0. The following part (Ta2) is a period in which the actuators return from the print state to the paused state. Note that the recording period T is equal to a period T2 (second voltage application period) which is from a starting time point of voltage application to the second active portion 19*x* until an ending time point of the voltage application.

As shown in FIG. 8, the preceding part (Ta1) is a period corresponding to a first predetermined period Ta1 (from time point t1 to time point t2). Voltage applied to the second active portion 19*x* (potential difference between the internal electrode and the common electrode sandwiching the second active portion 19*x* therebetween) increases from the second low voltage VL2 to the second high voltage VH2 at time point t1 and returns from the second high voltage VH2 to the second low voltage VL2 at time point t2 (FIG. 9B). Time point t2 is also a time point when voltage applied to the first active portion 18*x* (potential difference between the surface electrode and the internal electrode sandwiching the first active portion 18*x* therebetween) increases from the first low voltage VL1 to the first high voltage VH1. In this way, the actuator shifts from the paused state to the standby state.

In the middle part (T1), driving voltages are applied to the both active portions 18*x* and 19*x* based on first and second driving signals generated from image data. During this period, the actuators are selectively driven for each recording cycle T0 so that an image is formed on paper P. In the present embodiment, time point t3 is the actual starting point of image forming operation (ink ejecting operation), where time point t3 is a period XA (for example, 50 to 100 μsec: see FIGS. 9A and 9B) after time point t2. Even if some pressure fluctuation remains in the channels (particularly in the pressure chambers 16) at time point t2, which is the ending time point of the preceding part (Ta1), a state without pressure fluctuation is obtained after the period XA elapses. The middle part (T1) continues until time point t5 which is the ending time point of an image forming operation. Thus, the middle part (T1) consists of a standby-state continuation period (from time point t2 until time point t3) and an image forming period (from time point t3 until time point t5).

As shown in FIG. 8, the following part (Ta2) is a period corresponding to a second predetermined period Ta2 starting from time point t5. Voltage applied to the first active portion 18*x* changes to the first low voltage VL1 at time point t5, and this value is maintained until time point t6 which is the ending time point of the following part. On the other hand, voltage applied to the second active portion 19*x* is maintained at the second high voltage VH2 during this period, and changes to the second low voltage VL2 at time point t6. At time point t6, the electric potentials of the surface electrode 18 and the internal electrode 19 become the same as the electric potential of the common electrode 20. This state continues until the starting time point of the next recording period T.

It is preferable that the first predetermined period Ta1 and the second predetermined period Ta2 be set to values that are greater than or equal to 3AL (three times AL) and less than or equal to one recording cycle T0. In the present embodiment, the first and second predetermined periods Ta1 and Ta2 are set to 20 to 50 μsec (microseconds). Here, AL is one half (½) of the natural vibration cycle of ink within the individual ink channel 14, and is a time period represented as 1/v where 1 is the channel length of the individual ink channel 14 and v is the velocity of pressure wave in ink.

The controller 1*p* generates first and second driving signals based on image data included in a print command. As shown in FIGS. 9A and 9B, voltages applied based on the first and second driving signals each includes one or more rectangular-shaped pulse voltage formed by voltage changes between the low voltage VL1 or VL2 and the high voltage VH1 or VH2 with time width, for each recording cycle T0 (a time period required for paper P to move relative to the head 10 by a unit distance corresponding to resolution of an image to be recorded on the paper P).

In the present embodiment, as a method of driving the actuators, a so-called "pull and eject method" is adopted where an ink supply operation into the pressure chamber 16 is performed prior to an ink ejection operation from the ejection port 14*a*, assuming that each of the active portions 18*x* and 19*x* is displaced with the vibration mode $d_{31}$.

Figure 10A:
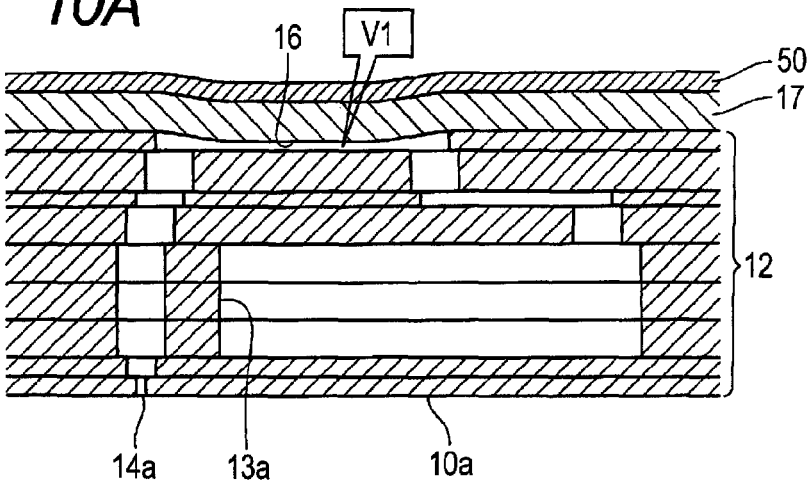
FIGS. 10A through 10C are partial cross-sectional views of a part shown in FIG. 4, for illustrating a driving operation of an actuator.
Figure 10B:
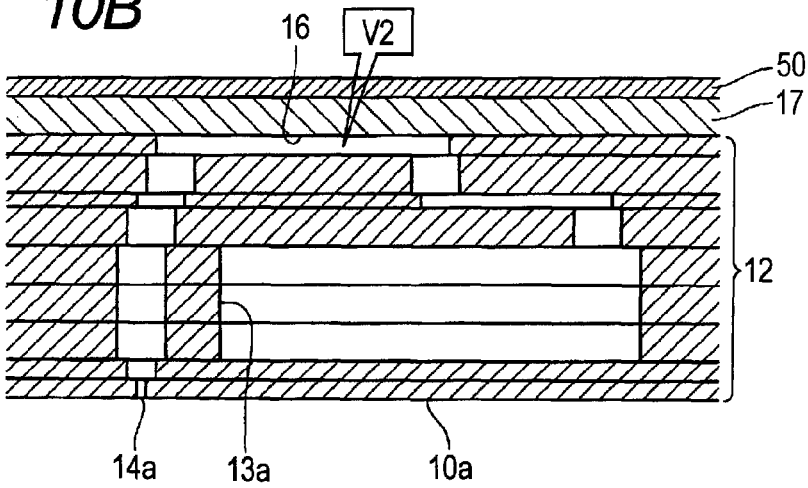
Figure 10C:
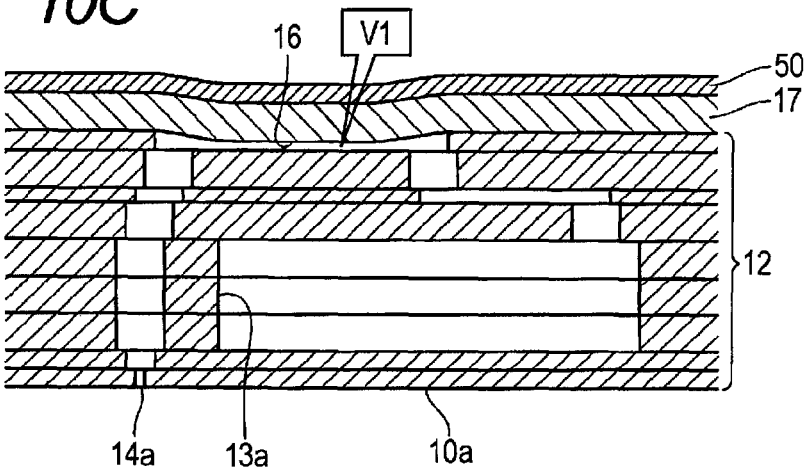

In the pull and eject method, ejection of one ink droplet is performed following an ink supply operation into the pressure chamber 16. For example, during a period in which a standby state continues (an initial certain period of the middle part (T1): from time point t2 until time point t3), all the actuators of the actuator unit 17 are kept at a state where the volume of the pressure chamber 16 is V1. At this time, as shown in FIG. 10A, the actuator is deformed to be convex toward the pressure chamber 16. This state is obtained by applying the first high voltage VH1 to the first active portion 18*x* and by applying the second low voltage VL2 to the second active portion 19*x*. When each driving signal is supplied at time point t3 (the starting time point of the recording cycle T0), the first active portion 18*x* is applied with the first low voltage VL1, and electric potential of each electrode becomes the same as the electric potential of the common electrode 20. At this time, deformation of the actuator is released, and the actuator returns to a flat state as shown in FIG. 10B. Because the volume of the pressure chamber 16 changes from V1 to V2 larger than V1, supplying of ink is started from the subsidiary manifold channel 13*a* to the pressure chamber 16. At the time when ink for supply reaches the pressure chamber 16 (time point t4 in FIG. 9A), the first active portion 18*x* is again applied with the first high voltage VH1. At this time, as shown in FIG. 10C, the actuator deforms to be convex toward the pressure chamber 16. With a decrease in volume of the pressure chamber 16 (V2 to V1), energy is applied to ink from the actuator so that one ink droplet is ejected from the ejection port 14*a*.

Subsequently, a series of operations including ink supplying to the pressure chamber 16 and ink ejection from the ejection port 14*a* as described above is repeated from time point t3 at each recording cycle T0 by the same number of times as the number of ink droplets to be ejected. Note that the deformation states during periods XA, XB, and XC in FIG. 9A corresponds to the states shown in FIGS. 10A, 10B, and 10C, respectively.

As shown in FIGS. 9A and 9B, the recording cycle T0 is temporally divided into: a former part in which ink ejection is performed (maximum pulse length T01); and a latter part in which meniscus vibration is performed (remaining period T02 subsequent to the maximum pulse length T01).

In the former part, pulse voltages contributing ink ejection are applied to the first active portion 18*x*, so that ink droplets are ejected from the ejection port 14*a*. During this period, pulse voltages are applied to the surface electrode 18 while maintaining electric potentials of the internal electrode 19 and the common electrode 20 at 0V. In an example of FIGS. 9A and 9B, three droplets of ink are ejected in the former part of the first recording cycle T0, and two droplets are ejected in the former part of the second recording cycle T0. Although not shown in FIGS. 9A and 9B, in the former part, pulse voltages corresponding to ejection of zero or one ink droplet can also be applied to the first active portion 18*x*.

In the latter part (T02), pulse voltages contributing meniscus vibration are applied to the second active portion 19*x*, so that a meniscus is vibrated in the ejection port 14*a* without ejecting ink. During this period, as shown in FIG. 9B, three pulse voltages are applied to the second active portion 19*x*. Each of these pulse voltages has a pulse height of the second high voltage VH2, and has a narrower pulse width than the pulse voltage applied to the first active portion 18*x* in the former part (T01). After the third pulse voltage is applied, the second active portion 19*x* is kept at the second low voltage VL2. On the other hand, the first active portion 18*x* is kept at the first low voltage VL1 during a period in which three pulse voltages are applied to the second active portion 19*x*. When the second low voltage VL2 is applied to the second active portion 19*x* after application of the third pulse voltage, the first high voltage VH1 is applied to the first active portion 18*x*. The first high voltage VH1 of the first active portion 18*x* and the second low voltage VL2 of the second active portion 19*x* are kept until the starting time point of the next recording cycle T0. Note that, at the ending time point t5 of the last recording cycle T0 (the recording cycle T0 leading to the following part (Ta2)) in the recording period T, voltage applied to the first active portion 18*x* is changed from the first high voltage VH1 to the first low voltage VL1, and voltage applied to the second active portion 19*x* is changed from the second low voltage VL2 to the second high voltage VH2.

As described above, the first driving signal applied to the surface electrode 18 (the first active portion 18*x*) is an ejection driving signal that, with only this signal, can cause a droplet to be ejected from the ejection port 14*a*. The second driving signal applied to the internal electrode 19 (the second active portion 19*x*) is a non-ejection driving signal that, with only this signal, cannot cause a droplet to be ejected from the ejection port 14*a* even if the signal is amplified to a predetermined voltage, and that causes a meniscus formed in the ejection port 14*a* to be vibrated without causing a droplet to be ejected from the ejection port 14*a*. That is, a change of the first driving signal from the first low voltage VL1 to the first high voltage VH1 applies a larger amount of energy to ink within the pressure chamber 16 than a change of the second driving signal from the second low voltage VL2 to the second high voltage VH2 does.

Generally, piezoelectric-type actuators have tendency that piezoelectric performance deteriorates with an increase of the voltage application period. In addition, an increase of the voltage application period leads to an increase of power consumption.

With this problem, it can be conceived that, in order to reduce the voltage application period, piezoelectric-type actuators are maintained at low voltages (for example, 0V) except at the time of recording, and are applied with pulse voltages at the time of recording (that is, voltage is changed from 0V to a positive or negative value immediately before recording on a recording medium is started, and is returned to 0V immediately after recording on the recording medium is finished). In this case, however, due to a sudden change in voltage, volume of the pressure chamber changes abruptly, which may cause leakage of ink (inadvertent ejection or dropping of ink from the ejection port).

In contrast, according to the printer 1, the controller 1*p*, and the storage medium storing a set of program instructions according to the present embodiment, when an image is formed on one sheet of paper P, voltages applied to the first active portion 18*x* and the second active portion 19*x* are maintained at the first low voltage VL1 and the second low voltage VL2, respectively, at least during periods prior to and subsequent to the recording period T. In particular, voltage applied to the first active portion 18*x* is the first low voltage VL1 during periods prior to and subsequent to the period T1 (the period of the middle part (T1)) in the recording period T. This reduces time period (duration) in which voltage is applied to piezoelectric-type actuators.

Further, during periods prior to and subsequent to the period T1, voltage applied to the second active portion 19*x* is maintained at the second high voltage VH2. At this time, considering that the second active portion 19*x* is arranged at approximately the center with respect to the stacking direction of the piezoelectric layers, and that the second high voltage VH2 is smaller than the first high voltage VH1, the deformation amount of the entire actuator is smaller than the case when the first high voltage VH1 is applied to the first active portion 18*x* for ejecting ink. For example, when shifting from the paused state to the standby state, the actuator goes through an intermediate deformation state in the preceding part (Ta1). Hence, the actuator deforms gradually, and ink does not leak (drop) from the ejection port 14*a*. The same goes for when shifting from the middle part (T1) to the paused state via the following part (Ta2), and ink does not leak from the ejection port 14*a*.

Hence, according to the present embodiment, it is possible to reduce the voltage application period of the piezoelectric-type actuators and also to prevent leakage of ink.

In addition, because two piezoelectric layers 17*a* and 17*b* stacked with each other are used in order to apply gradually-changed voltages, voltage controls are easy compared with the case when a single piezoelectric layer is used.

The roles of the first and second driving signals are different from each other. More specifically, the first driving signal is an ejection driving signal that, with only this signal, can cause a droplet to be ejected from the ejection port 14*a*, and the second driving signal is a non-ejection driving signal that causes a meniscus to be vibrated. That is, the roles of the piezoelectric layers 17*a* and 17*b* are different from each other. Because one actuator is provided with two piezoelectric layers 17*a* and 17*b* of which roles are divided into recording and meniscus vibration in this way, it is possible to reduce time period (duration) in which voltage is applied to the piezoelectric layer 17*a* for recording, compared with the case when a single piezoelectric layer is used for both recording and meniscus vibration. Hence, deterioration of the piezoelectric performance of the piezoelectric layer 17*a* for recording can be suppressed. In other words, it is possible to maintain conditions of menisci and to keep recording quality well, while suppressing deterioration of the piezoelectric performance of the actuator. In addition, it is very efficient because ink leakage is prevented by utilizing the piezoelectric layer 17*b* for meniscus vibration.

Because the piezoelectric layer 17*a*, which is the outermost layer and has high deformation efficiency, is used for recording, ejection for recording can be performed efficiently, and an improvement in recording quality can be achieved.

In the present embodiment, the pull and eject method is used as a method of driving the actuators. In this case, too, it is possible to reduce time period (duration) in which voltage is applied to the piezoelectric actuator while preventing ink leakage.

In the present embodiment, during periods except the recording period T and the preliminary ejection period, voltages applied to the active portions 18*x* and 19*x* are maintained at the low voltages VL1 and VL2, respectively. That is, as shown in FIG. 7, the active portions 18*x* and 19*x* are maintained at the low voltages VL1 and VL2, respectively, during periods except the recording period T and the preliminary ejection period. Thus, it is possible to reduce time period (duration) in which voltage is applied to the piezoelectric actuator more reliably.

In the present embodiment, pulse voltages included in the first and second driving signals are rectangular-shaped. Hence, controls are easy compared with the case when pulse voltages have complicated shapes (for example, a shape including a step part at which electric potential is increased or decreased stepwise).

In the present embodiment, the electric potential indicated by each of the first and second driving signals is two-valued. That is, the first driving signal has two values of the first low voltage VL1 and the first high voltage VH1, and the second driving signal has two values of the second low voltage VL2 and the second high voltage VH2. Hence, it is possible to avoid inconveniences in the case when each signal has more than two values (structural and economical inconveniences that the number of power sources needs to be increased, and an inconvenience that the controls become more difficult).

The piezoelectric layers 17*a* and 17*b* are arranged to straddle two or more pressure chambers 16. Hence, a layered body including the piezoelectric layers 17*a* and 17*b* is effective in terms of production and durability. Further, the surface electrode 18 and the internal electrode 19 can be formed by the printing method or the like, and arrangement of electrodes with high density can be achieved with ease.

The actuator unit 17 includes the vibration plate 17*c*. With this arrangement, in each actuator of the actuator unit 17, deformation of unimorph type, bimorph type, multimorph type, and the like can be implemented using the vibration plate 17*c*. Further, by interposing the vibration plate 17*c* between the layered body of the piezoelectric layers 17*a*, 17*b* and the channel unit 12, it is possible to prevent electrical defect such as short circuit that may occur due to migration of ink ingredient within the pressure chamber 16 when voltage is applied to each of the active portions 18*x* and 19*x*.

Among the electrodes included in the actuator unit 17, the common electrode 20 closest to the pressure chamber 16 is a ground electrode. If the common electrode 20 is not electrically connected to ground, potential difference is created between ink within the pressure chamber 16 and the common electrode 20, and migration of ink ingredient within the pressure chamber 16 can generate short circuit. In the present embodiment, however, this problem can be avoided.

Further, the common electrode 20 extends over the entirety of the surface of the vibration plate 17*c*. With this arrangement, electrical defect caused by leakage electric field (for example, electrical short circuit due to electroendosmosis of ink ingredient in the pressure chamber 16) can be prevented.

If the piezoelectric layers 17*a* and 17*b* are polarized in the opposite directions along the stacking direction from each other, a ground electrode needs to be provided at a position between the piezoelectric layers 17*a* and 17*b* and at a position closest to the pressure chamber 16 in order to displace the piezoelectric layers 17*a* and 17*b* in the same direction. Here, the ground electrode arranged at the position closest to the pressure chamber 16 has a function of cutting off electric field exerted on ink within the pressure chamber 16. However, because the ground electrode is a rigid body, deformation of the actuator could be hindered if ground electrodes are provided at two positions as described above. In contrast, according to the present embodiment, the piezoelectric layers 17*a* and 17*b* are polarized in the same direction along the stacking direction. Hence, it is sufficient that the common electrode 20, which is a ground electrode, is provided only at a position closest to the pressure chamber 16, thereby suppressing worsening of efficiency in deformation of the actuator.

In the present embodiment, voltage applied to the second active portion 19*x* is maintained at the second high voltage VH2 from time point t5, which is the ending time point of the voltage application period T1 of the first active portion 18*x*, until time point t6, and is changed from the second high voltage VH2 to the second low voltage VL2 at time point t6. That is, as shown in FIGS. 8 and 9B, the internal electrode 19 is maintained at the second high voltage VH2 from time point t5 until time point t6. In this way, not only at the starting of the recording period T (from time point t1 to time point t2) but also at the end of the recording period T (from time point t5 to time point t6), voltages are applied so that the deformation amount of the entire actuator including the first active portion 18*x* and the second active portion 19*x* changes gradually, thereby preventing ink leakage due to a sudden change in volume of the pressure chamber 16.

The both values of the first low voltage VL1 and the second low voltage VL2 are 0V, and the value of the second high voltage VH2 is one half (½) of the value of the first high voltage VH1. Hence, voltages can be controlled with ease.

The individual electrodes 19*a* forming the respective second active portions 19*x* are electrically connected by the connection electrodes 19*b* with one another. Thus, wiring configuration and configuration for supplying signals to the internal electrode 19 can be simplified. Additionally, because processing time of supplying signals is shortened, high-speed recording can be achieved. Further, because application of voltage is performed in the same mode for the plurality of second active portions 19*x*, variances among the actuators in deterioration of piezoelectric performance can be suppressed.

Next, an inkjet-type printer embodying a liquid ejecting device according to another embodiment will be described.

The printer according to this embodiment differs from the above-described printer 1 only in the configuration of the internal electrode 19. That is, in this embodiment, the individual electrodes 19*a* of the internal electrode 19 are not electrically connected with one another by the connection electrodes 19*b* (electrically separate from one another), but are formed independently for each pressure chamber 16 like the surface electrodes 18. Accordingly, in this embodiment, wiring is provided individually for each individual electrode 19*a*, so that values of voltages applied to the plurality of individual electrodes 19*a* (second active portions 19*x*) are determined individually. Here, the value of voltage applied to each individual electrode 19*a* is set by considering a actual time period during which voltage is applied to each actuator, so that the amount of deformation during the voltage application period (T2) for one sheet of paper P is uniform among the actuators. For example, as the actual time period during which voltage is applied to one actuator is longer, voltage applied to the individual electrode 19*a* of that actuator is set to a lower value. Conversely, as the actual time period during which voltage is applied to one actuator is shorter, voltage applied to the individual electrode 19*a* of that actuator is set to a higher value. Hence, variances in deterioration of piezoelectric performance among the actuators can be suppressed.

While the invention has been described in detail with reference to the above embodiments thereof, it would be apparent to those skilled in the art that various changes and modifications may be made therein without departing from the scope of the claims.

For example, the values of the first and second low voltages and the first and second high voltages may be set arbitrarily by considering thickness and arrangement of piezoelectric layers and electrodes, for example, as long as a change from the first low voltage to the first high voltage applies a larger amount of energy to liquid within the pressure chamber than a change from the second low voltage to the second high voltage does. For example, values of the first and second low voltages may be positive or negative values, not necessarily 0V. Here, it is preferable that energy obtained by a change from the second low voltage to the second high voltage be approximately one half (½) of energy obtained by a change from the first low voltage to the first high voltage.

The periods during which voltage applied to the active portion 18*x*, 19*x* is kept at the first and second low voltage, respectively, are not limited to periods except the recording period T and the period for recovery and maintenance operations. Here, the recovery and maintenance operations are not limited to the above-described preliminary ejection, but may be an operation of meniscus vibration by driving of the actuator. For example, this operation of meniscus vibration may be performed immediately prior to the recording period T.

Each of the first and second predetermined periods may be set arbitrarily. Further, changes in voltage from time point t2 to time point t5 are not limited to an example of FIGS. 9A and 9B, but may be modified arbitrarily. For example, in the case when a push and eject method described later is adopted as the driving method of the actuator, the recording cycle T0 may start at time point t2 and, at the timing of rising of pulse voltage at this time, ink may be ejected from the ejection port 14*a*. In this case, during the beginning part (a predetermined period from time point t2, for example, 10 μsec) and/or the ending part (a predetermined period prior to time point t5) of the period T1, voltage applied to the first active portion 18*x* may be kept at the first high voltage VH1 so as to stabilize meniscus.

It is not necessary to perform an operation of meniscus vibration in the latter part of the recording cycle T0. In this case, voltage of the second active portion 19*x* may be kept at 0V from time point t3 until immediately prior to time point t5.

It is not necessary to apply voltage so as to change gradually at the end of the recording period T (from time point t5 until time point t6). For example, in FIGS. 9A and 9B, voltage of 0V may be applied to each of the active portions 18*x* and 19*x* at time point t5.

Pulse voltages included in the first and second driving signals are not limited to rectangular shapes and, for example, may be a shape including a step portion at which electric potential is increased or decreased stepwise. Further, the electric potential indicated by each of the first and second driving signals is not limited to being two-valued.

The driving method of the actuators is not limited to the pull and eject method. For example, a so-called "push and eject method" may be adopted as the driving method of the actuators, assuming that each of the active portions 18*x* and 19*x* is displaced with the vibration mode $d_{33}$. In this case, it is not necessary to provide a discharging period at the beginning of the period T1. Ink is ejected from the ejection port 14*a* at the timing of rising of pulse voltages, and ink is supplied to the pressure chamber 16 at the timing of falling of pulse voltages.

It is not necessary that the first piezoelectric layer is the outermost layer. For example, the piezoelectric layer 17*b*, which is the intermediate layer, may serve as the first piezoelectric layer; and the piezoelectric layer 17*a*, which is the outermost layer, may serve as the second piezoelectric layer.

The second piezoelectric layer is not limited to use of meniscus vibration.

The piezoelectric layers 17*a* and 17*b* may be polarized in the opposite directions along the stacking direction from each other.

Additionally, the arrangement and shape of the piezoelectric layers and electrodes included in the actuator as well as the deformation mode of the actuator are not limited to those described in the above embodiments and may be modified in various ways.

For example, in the above-described embodiments, the thickness of the vibration plate 17*c* is greater than or equal to the sum of the thickness of the piezoelectric layer 17*a* and the thickness of the piezoelectric layer 17*b*, and the thickness of the piezoelectric layer 17*a* for recording is the same as the thickness of the piezoelectric layer 17*b* for meniscus vibration. However, the thickness of each piezoelectric layer included in the actuator is not limited to the above-described relationship, and may be set appropriately. For example, the thickness of the vibration plate 17*c* may be smaller than the sum of the thickness of the piezoelectric layer 17*a* and the thickness of the piezoelectric layer 17*b*, and the thickness of the piezoelectric layer 17*a* for recording may be greater than the thickness of the piezoelectric layer 17*b* for meniscus vibration.

The deformation mode of the actuator is not to limited to the unimorph type, and may be other deformation modes such as a monomorph type, bimorph type, multimorph type, and a modified type of the monomorph type etc.

In the actuator unit 17, another piezoelectric layer may be stacked on the piezoelectric layer 17*a* as the upper layer, or one or a plurality of piezoelectric layers may be sandwiched between the piezoelectric layers 17*a* and 17*b*. Further, the vibration plate 17*c* may be omitted.

In the above-described embodiments, the actuator unit 17 corresponding to a pressure-chamber group including two or more pressure chambers is illustrated. However, the actuator of the invention is not limited to this configuration. For example, a layered body formed by first and second piezoelectric layers may be provided individually for each pressure chamber.

The liquid ejecting device of the invention is not limited to a printer, but can be applied to a facsimile apparatus, a copier, and the like. Further, it can also be applied to an apparatus that ejects liquid other than ink.

If pressure fluctuation remaining in the channel is such a degree that does not affect ejection performance of ink practically at time point t2 which is the ending time point of the preceding part (Ta1) in the recording period T, then the operation may shift to a pull-and-eject operation or a push-and-eject operation immediately after time point t2, without going through a continuation period of a standby state (a period XA: from time point t2 until time point t3) subsequent to the preceding part.

The recording medium is not limited to paper P, and may be cloth or the like, as long as it is a recordable medium.

What is claimed is:

1. A liquid ejecting device comprising:

a channel member formed with a liquid channel having a plurality of ejection ports for ejecting liquid and a plurality of pressure chambers in fluid communication with respective ones of the plurality of ejection ports;

a piezoelectric-type actuator including a layered body disposed on the channel member so as to confront the plurality of pressure chambers for applying energy to liquid in the plurality of pressure chambers, the layered body including a first piezoelectric layer and a second piezoelectric layer, the actuator including a first active portion and a second active portion at parts of the first piezoelectric layer and the second piezoelectric layer, respectively, in confrontation with each of the plurality of pressure chambers, the first active portion and the second active portion being sandwiched between electrodes with respect to a stacking direction;

a driving-signal generating section configured to generate a driving signal for driving the actuator based on image data of an image to be recorded on a recording medium, the driving signal including a first driving signal applied to the first active portion and a second driving signal applied to the second active portion; and a driving-signal applying section configured to apply the first driving signal and the second driving signal to the first active portion and the second active portion, respectively, wherein the first driving signal includes one or more pulse voltage formed by a voltage change between a first low voltage and a first high voltage, the one or more pulse voltage having time width;

wherein the second driving signal includes one or more pulse voltage formed by a voltage change between a second low voltage and a second high voltage, the one or more pulse voltage having time width;

wherein the voltage change of the first driving signal from the first low voltage to the first high voltage applies a larger amount of energy to the liquid in each of the plurality of pressure chambers than the voltage change of the second driving signal from the second low voltage to the second high voltage; and wherein the driving-signal applying section is configured to maintain the first driving signal at the first low voltage prior to and subsequent to a first voltage application period during which voltage is applied to the first active potion based on the image data for one recording medium, to maintain the second driving signal at the second low voltage prior to and subsequent to a second voltage application period during which voltage is applied to the second active portion based on the image data for the one recording medium, to change the second driving signal from the second low voltage to the second high voltage at a first time point that is a first predetermined period before a second time point that is a starting time point of the first voltage application period, and to maintain the second driving signal at the second high voltage from the first time point until the second time point, to change the first driving signal from the first low voltage to the first high voltage and the second driving signal from the second high voltage to the second low voltage at the second time point, to maintain the first driving signal at the first high voltage and the second driving signal at the second low voltage from the second time point until a third time point that is a second predetermined period after the second time point, to change the first driving signal from the first high voltage to the first low voltage at the third time point, and to maintain the first driving signal at the first low voltage and the second driving signal at the second low voltage from the third time point until a fourth time point that is a third predetermined period after the third time point.

2. The liquid ejecting device according to claim 1, wherein the first driving signal is an ejection driving signal that, with only said ejection driving signal, can cause liquid to be ejected from the ejection port; and wherein the second driving signal is a non-ejection driving signal that, with only said non-ejection driving signal, cannot cause liquid to be ejected from the ejection port and that causes a meniscus formed in the ejection port to be vibrated without causing liquid to be ejected from the ejection port.

3. The liquid ejecting device according to claim 2, wherein the first piezoelectric layer is an outermost layer which is the farthest away from the plurality of pressure chambers among piezoelectric layers included in the layered body.

4. The liquid ejecting device according to claim 1, wherein the actuator is configured to perform a pull and eject operation, such that an ink supply operation into at least one of the plurality of pressure chambers is performed prior to an ink ejection operation from a corresponding at least one of the plurality of ejection ports.

5. The liquid ejecting device according to claim 1, wherein the driving-signal applying section is configured to maintain the first driving signal and the second driving signal at the first low voltage and the second low voltage, respectively, during periods except the first and second voltage application periods and a period during which operations for recovering and maintaining liquid ejection performance of the ejection port are performed.

6. The liquid ejecting device according to claim 1, wherein the one or more pulse voltage included in the first driving signal and the second driving signal is rectangular-shaped.

7. The liquid ejecting device according to claim 1, wherein electric potential indicated by each of the first driving signal and the second driving signal is two-valued.

8. The liquid ejecting device according to claim 1, wherein the first piezoelectric layer and the second piezoelectric layer are arranged to straddle two or more of the plurality of pressure chambers.

9. The liquid ejecting device according to claim 1, wherein the actuator further comprises a vibration plate disposed between the layered body and the channel member to seal the plurality of pressure chambers.

10. The liquid ejecting device according to claim 1, wherein an electrode in the actuator that is closest to the plurality of pressure chambers is a ground electrode.

11. The liquid ejecting device according to claim 10, wherein the ground electrode extends over an entirety of a surface on which the ground electrode is formed.

12. The liquid ejecting device according to claim 10, wherein the first and second piezoelectric layers are polarized in the same direction along the stacking direction.

13. The liquid ejecting device according to claim 1, wherein the driving-signal applying section is configured to maintain the second driving signal at the second high voltage from a fifth time point that is an ending time point of the first voltage application period until a sixth time point that is a fourth predetermined period after the fifth time point, and to change the second driving signal from the second high voltage to the second low voltage at the sixth time point.

14. The liquid ejecting device according to claim 1, wherein both of the first low voltage and the second low voltage are zero volt (0V); and wherein a value of the second high voltage is one half of a value of the first high voltage.

15. The liquid ejecting device according to claim 1, wherein the second active portion comprises two or more second active portions; and wherein electrodes constituting each of the two or more second active portions are electrically connected with one another, the electrodes being formed on a surface of the second piezoelectric layer.

16. The liquid ejecting device according to claim 1, wherein the second active portion comprises two or more second active portions, and the actuator comprises two or more actuators corresponding to respective ones of the two or more second active portions;

wherein electrodes constituting each of the two or more second active portions are electrically separate from one another, the electrodes being formed on a surface of the second piezoelectric layer; and wherein the driving-signal generating section is configured to determine values of voltage applied to each of the two or more second active portions, so that an amount of deformation during the second voltage application period for one recording medium is uniform among the two or more actuators.

17. The liquid ejecting device according to claim 1, wherein the first predetermined period is a period for gradually deforming the piezoelectric-type actuator;

wherein the second predetermined period is a period for shifting to a state without pressure fluctuation; and wherein the third predetermined period is a period for supplying the plurality of pressure chambers with ink.

18. A controller for use in a liquid ejecting device, the liquid ejecting device including: a channel member formed with a liquid channel having a plurality of ejection ports for ejecting liquid and a plurality of pressure chambers in fluid communication with respective ones of the plurality of ejection ports; and a piezoelectric-type actuator including a layered body disposed on the channel member so as to confront the plurality of pressure chambers for applying energy to liquid in the plurality of pressure chambers, the layered body including a first piezoelectric layer and a second piezoelectric layer, the actuator including a first active portion and a second active portion at parts of the first piezoelectric layer and the second piezoelectric layer, respectively, in confrontation with each of the plurality of pressure chambers, the first active portion and the second active portion being sandwiched between electrodes with respect to a stacking direction, the controller comprising:

a driving-signal generating section configured to generate a driving signal for driving the actuator based on image data of an image to be recorded on a recording medium, the driving signal including a first driving signal applied to the first active portion and a second driving signal applied to the second active portion; and a driving-signal applying section configured to apply the first driving signal and the second driving signal to the first active portion and the second active portion, respectively, wherein the first driving signal includes one or more pulse voltage formed by a voltage change between a first low voltage and a first high voltage, the one or more pulse voltage having time width;

wherein the second driving signal includes one or more pulse voltage formed by a voltage change between a second low voltage and a second high voltage, the one or more pulse voltage having time width;

wherein the voltage change of the first driving signal from the first low voltage to the first high voltage applies a larger amount of energy to the liquid in each of the plurality of pressure chambers than the voltage change of the second driving signal from the second low voltage to the second high voltage; and wherein the driving-signal applying section is configured to maintain the first driving signal at the first low voltage prior to and subsequent to a first voltage application period during which voltage is applied to the first active portion based on the image data for one recording medium, to maintain the second driving signal at the second low voltage prior to and subsequent to a second voltage application period during which voltage is applied to the second active portion based on the image data for the one recording medium, to change the second driving signal from the second low voltage to the second high voltage at a first time point that is a first predetermined period before a second time point that is a starting time point of the first voltage application period, to maintain the second driving signal at the second high voltage from the first time point until the second time point, to change the first driving signal from the first low voltage to the first high voltage and the second driving signal from the second high voltage to the second low voltage at the second time point, to maintain the first driving signal at the first high voltage and the second driving signal at the second low voltage from the second time point until a third time point that is a second predetermined period after the second time point, to change the first driving signal from the first high voltage to the first low voltage at the third time point, and to maintain the first driving signal at the first low voltage and the second driving signal at the second low voltage from the third time point until a fourth time point that is a third predetermined period after the third time point.

19. A non-transitory tangible storage medium storing a set of program instructions executable on a liquid ejecting device including: a channel member formed with a liquid channel having a plurality of ejection ports for ejecting liquid and a plurality of pressure chambers in fluid communication with respective ones of the plurality of ejection ports; and a piezoelectric-type actuator including a layered body disposed on the channel member so as to confront the plurality of pressure chambers for applying energy to liquid in the plurality of pressure chambers, the layered body including a first piezoelectric layer and a second piezoelectric layer, the actuator including a first active portion and a second active portion at parts of the first piezoelectric layer and the second piezoelectric layer, respectively, in confrontation with each of the plurality of pressure chambers, the first active portion and the second active portion being sandwiched between electrodes with respect to a stacking direction, the set of program instructions comprising:

generating a driving signal for driving the actuator based on image data of an image to be recorded on a recording medium, the driving signal including a first driving signal applied to the first active portion and a second driving signal applied to the second active portion; and applying the first driving signal and the second driving signal to the first active portion and the second active portion, respectively, wherein the first driving signal includes one or more pulse voltage formed by a voltage change between a first low voltage and a first high voltage, the one or more pulse voltage having time width;

wherein the second driving signal includes one or more pulse voltage formed by a voltage change between a second low voltage and a second high voltage, the one or more pulse voltage having time width;

wherein the voltage change of the first driving signal from the first low voltage to the first high voltage applies a larger amount of energy to the liquid in each of the plurality of pressure chambers than the voltage change of the second driving signal from the second low voltage to the second high voltage; and wherein the instructions for applying the first driving signal and the second driving signal comprise maintaining the first driving signal at the first low voltage prior to and subsequent to a first voltage application period during which voltage is applied to the first active portion based on the image data for one recording medium, maintaining the second driving signal at the second low voltage prior to and subsequent to a second voltage application period during which voltage is applied to the second active portion based on the image data for the one recording medium, changing the second driving signal from the second low voltage to the second high voltage at a first time point that is a first predetermined period before a second time point that is a starting time point of the first voltage application period, and maintaining the second driving signal at the second high voltage from the first time point until the second time point, to change the first driving signal from the first low voltage to the first high voltage and the second driving signal from the second high voltage to the second low voltage at the second time point, to maintain the first driving signal at the first high voltage and the second driving signal at the second low voltage from the second time point until a third time point that is a second predetermined period after the second time point, to change the first driving signal from the first high voltage to the first low voltage at the third time point, and to maintain the first driving signal at the first low voltage and the second driving signal at the second low voltage from the third time point until a fourth time point that is a third predetermined period after the third time point.

* * * * *